United States Patent [19]

Juel, Jr.

[11] Patent Number: 4,978,127

[45] Date of Patent: Dec. 18, 1990

[54] SELECTIVELY CONTOURABLE PUTTING GREEN

[76] Inventor: Charles H. Juel, Jr., 697 Second St., Stout, Iowa 50673

[21] Appl. No.: 495,709

[22] Filed: Mar. 19, 1990

[51] Int. Cl.[5] ..... A63B 67/02

[52] U.S. Cl. ..... 273/176 H; 273/DIG. 31; 273/176 FB

[58] Field of Search ..... 273/195 R, 198, 176 R, 273/176 E–176 H, DIG. 31

[56] References Cited

U.S. PATENT DOCUMENTS

| | | | |
|---|---|---|---|
| 1,582,237 | 4/1926 | Angell | 273/176 F |
| 2,243,720 | 5/1941 | Preece | 273/176 H |
| 2,678,823 | 5/1954 | Hugman | 273/176 H X |
| 3,170,694 | 2/1965 | Dolce | 273/176 H |
| 3,601,407 | 8/1971 | Lorrance | 273/176 H |
| 3,658,343 | 4/1972 | Rogers et al. | 273/176 H |
| 3,727,917 | 4/1973 | Maclean | 273/176 H |
| 3,735,988 | 5/1973 | Palmer et al. | 273/178 B |
| 3,831,949 | 8/1974 | Henning | 273/176 H |
| 3,843,136 | 10/1974 | Buenzle | 273/176 F |
| 3,856,313 | 12/1974 | Tierney | 273/176 FB |
| 3,936,055 | 2/1976 | Scott | 273/176 H |
| 4,124,210 | 11/1978 | Mason | 273/176 F |
| 4,222,568 | 9/1980 | Russo | 273/176 H |
| 4,240,637 | 12/1980 | Cross et al. | 273/176 H |
| 4,294,450 | 10/1981 | Gallie | 273/176 F |
| 4,783,075 | 11/1988 | Simjian | 273/176 FA |

*Primary Examiner*—Edward M. Coven
*Assistant Examiner*—Sebastiano Passaniti
*Attorney, Agent, or Firm*—Henderson & Sturm

[57] ABSTRACT

A selectively contourable putting green including an elongated platform having a rigid subbase supporting a flexible resilient base, which in turn supports a flexible putting surface. A number of contour bars are disposed in transverse slots formed in the subbase. The contour bars contact the under side of the flexible resilient base. Each end of each of the contour bars is independently selectively adjustable between a position flush with the level surface of the subbase and a position fully raised above the level surface. A selectively movable elevation block is associated with each end of each contour bar to position it at a predetermined level, thereby producing a selected contour of the putting surface along the length of the elongated platform.

21 Claims, 3 Drawing Sheets

SELECTIVELY CONTOURABLE PUTTING GREEN

TECHNICAL FIELD

This invention relates to practice putting surfaces, and more particularly to a selectively conturable putting green.

BACKGROUND ART

Numerous practice putting aids or games are known. Most of these, however, include complex expensive constructions that are difficult to set up or adjust. Also, many of these devices fail to simulate realistic golfing conditions and are difficult to transport from one location to another.

Those concerned with these and other problems recognize the need for an improved selectively contourable putting green.

DISCLOSURE OF THE INVENTION

The present invention provides a selectively contourable putting green including an elongated platform having a rigid subbase supporting a flexible resilient base, which in turn supports a flexible putting surface. A number of contour bars are disposed in transverse slots formed in the subbase. The contour bars contact the underside of the flexible resilient base. Each end of the contour bars is independently selectively adjustable between a position flush with the level surface of the subbase and a position fully raised above the level surface. A selectively movable elevation block is associated with each end of each contour bar to position it at a predetermined level, thereby producing a selected contour of the putting surface along the length of the elongated platform.

An object of the present invention is the provision of an improved selectively contourable putting green.

Another object is to provide a putting green that assumes a plurality of three dimensional contours.

A further object of the invention is the provision of a putting green having a putting surface that simulates the characteristics of an actual putting green.

Still another object is to provide a putting green that is modular and is easy to transport.

A still further object of the present invention is the provision of a putting green that is simple in construction and easy to set up and adjust.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
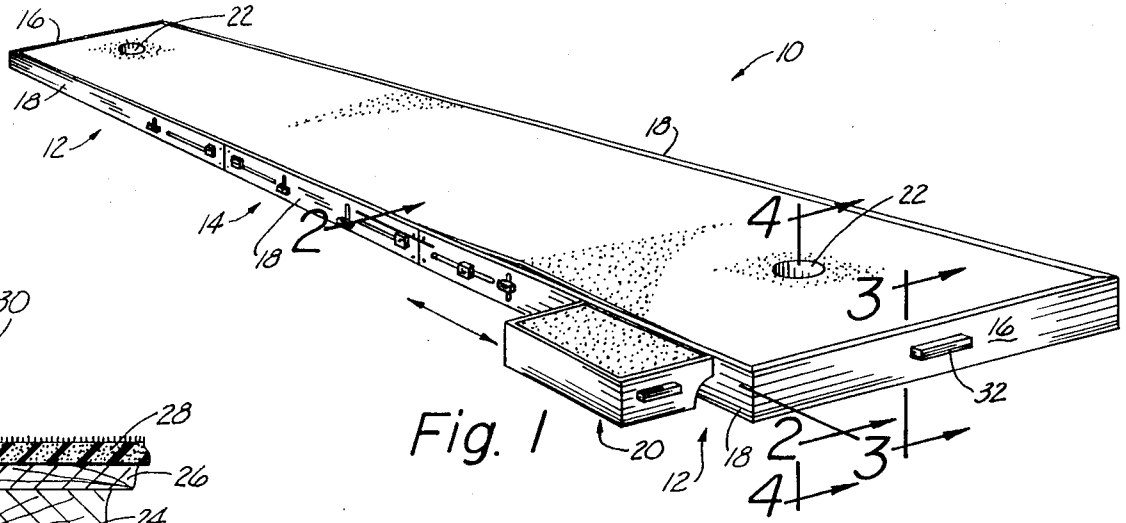
FIG. 1 is a perspective view of the putting green of the present invention.

Referring now to the drawings, wherein like reference numerals designate identical or corresponding parts throughout the several views, FIG. 1 shows the putting green (10) of the present invention. The putting green (10) includes an elongated platform formed by the pivotal connection of two end modules (12) and an intermediate module (14). The elongated platform is defined by a pair of end rails (16) interconnected by a pair of opposing side rails (18). A pad (20) is movable along the side of the platform to assist the player in remaining reasonably level with the platform.

Figure 4:
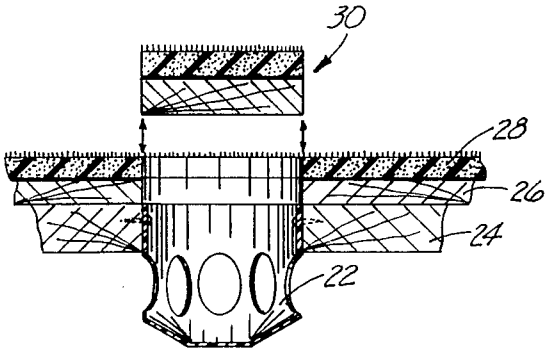
FIG. 4 is an enlarged sectional view taken along line 4—4 of FIG. 1 showing the layered construction of the platform, a cup secured to the subbase, and a plug to selectively close the cup opening.
Figure 5:
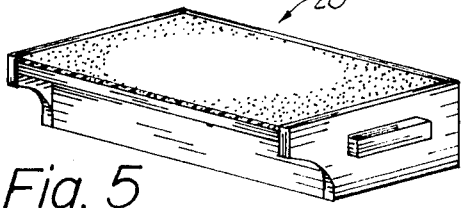
FIG. 5 is an enlarged persepctive view of the player pad shown in FIG. 1.

Each end module (12) carries a cup (22) as best shown in FIGS. 1 and 4. The cup (22) is secured to a rigid subbase (24), and the flexible resilient base (26) and the flexible putting surface (38) have openings that register with the opening for the cup (22). A circular plug (30) is formed of the same materials as the flexible resilient base (26) and the putting surface (28). The plug (30) is placed over the cup (22) if only one cup (22) is to be used on the putting green (10).

Figure 2:
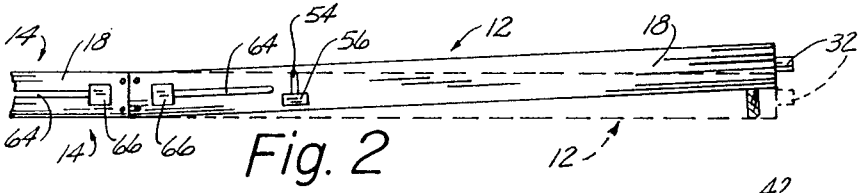
FIG. 2 is a partial side elevational view with a full line illustration of one end in an elevated position and a dashed line showing of the one end in a level position.
Figure 3:
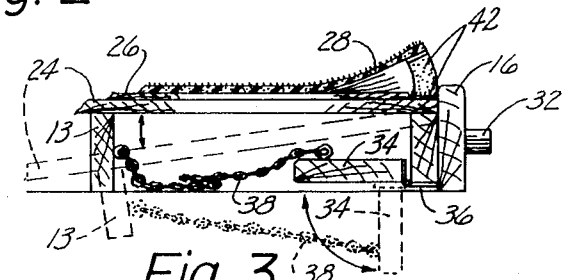
FIG. 3 is an enlarged sectional view taken along line 3—3 of FIG. 1 with a dashed line illustration of the transverse flap in the down position to elevate one end of the platform.

Referring now to FIGS. 2 and 3, each end rail (16) carries a grip (32) that can be grasped and elevated. When this is done, a transverse flap (34) pivots downwardly by hinge (36) and is restrained from further pivotal movement by the chain (38). To lower the end, the grip (32) is again elevated and the transverse flap (34) is pushed inward to the full line position shown in FIG. 3.

FIGS. 6–9 best show the construction of an end module (12) that includes a subbase (24) rigidly attached to the transverse stringers (13). The subbase (24) forms a substantially level surface that is interrupted by a transverse slot (40) that extends between the side rails (18). A flexible resilient base (26) is attached to the subbase (24) only adjacent the end rail (16) and a flexible putting surface (28) is attached adjacent the end rail (16) by a Velcro strip (42).

Figures 6, 7, 8:
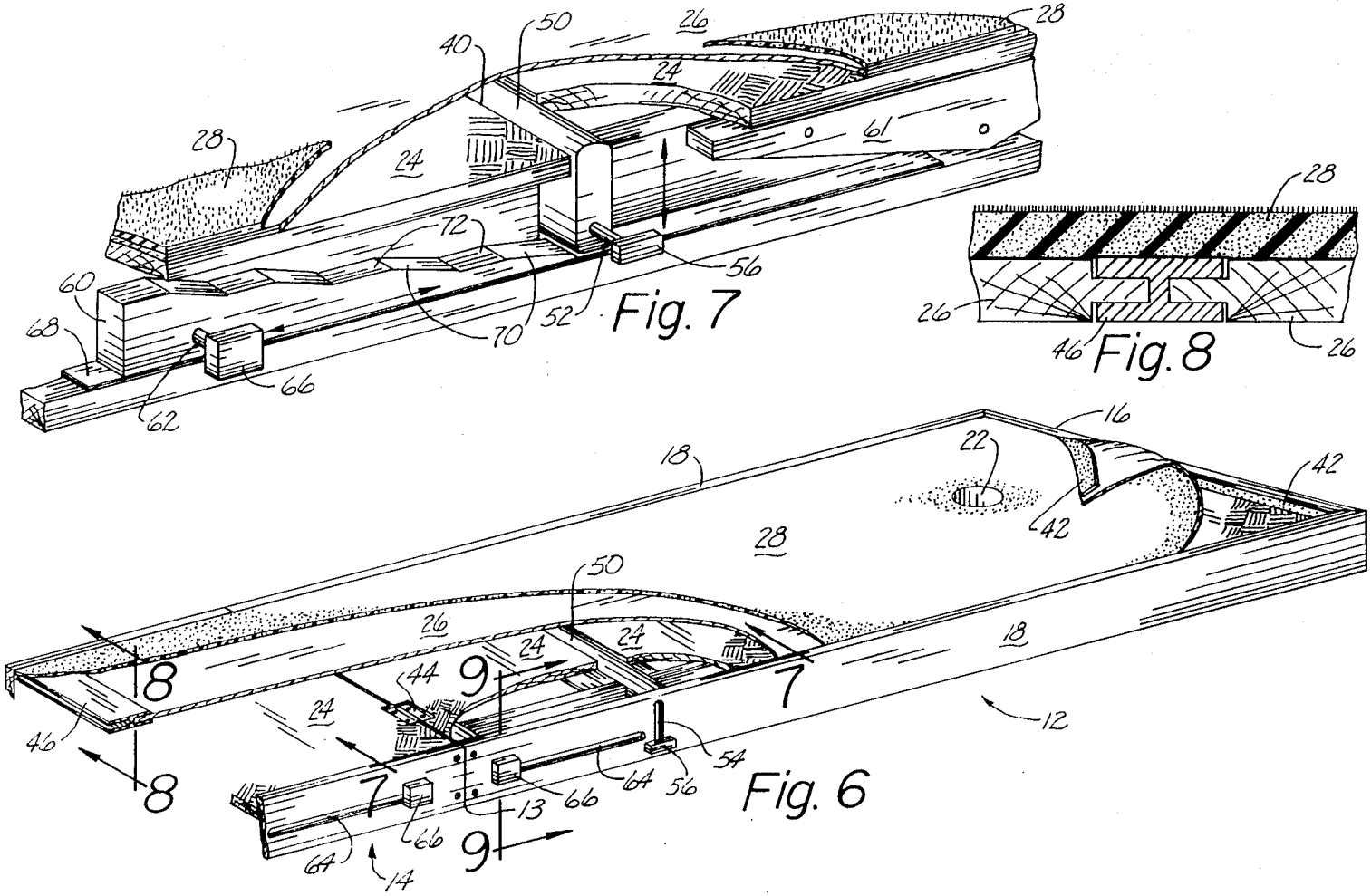
FIG. 6 is a partial cut-away perspective view illustrating the pivotal attachment of an end module to an intermediate module.
FIG. 7 is an enlarged partial cut-away perspective view taken along line 7—7 of FIG. 6 illustrating the vertical movement of one end of a contour bar in response to the horizontal positioning of an elevation block.
FIG. 8 is an enlarged sectional view taken along line 8—8 of FIG. 6 showing the connector joining two adjacent ends of the flexible resilient base material.
Figure 10:
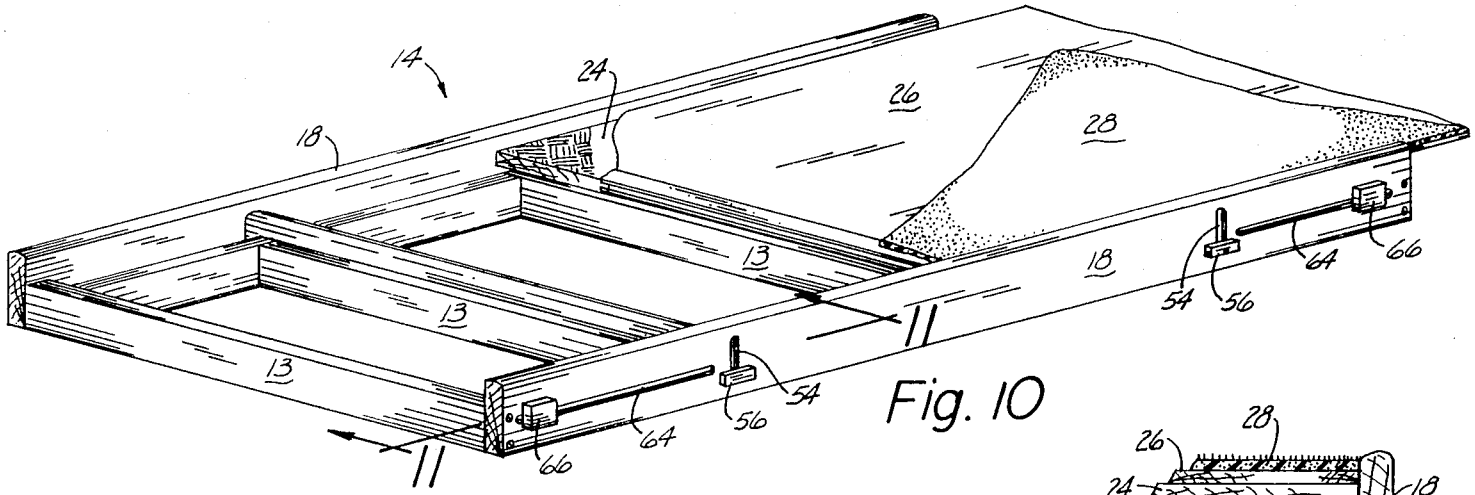
FIG. 10 is a cut-away perspective view of an intermediate module illustrating the contour bar extending between opposite side rails.
Figure 9:
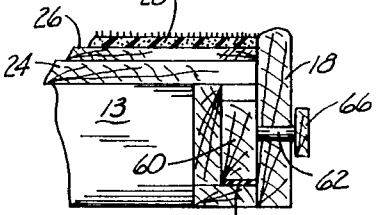
FIG. 9 is an enlarged sectional view taken along line 9—9 of FIG. 6 showing the pocket that guides the elevation block.
Figure 11:
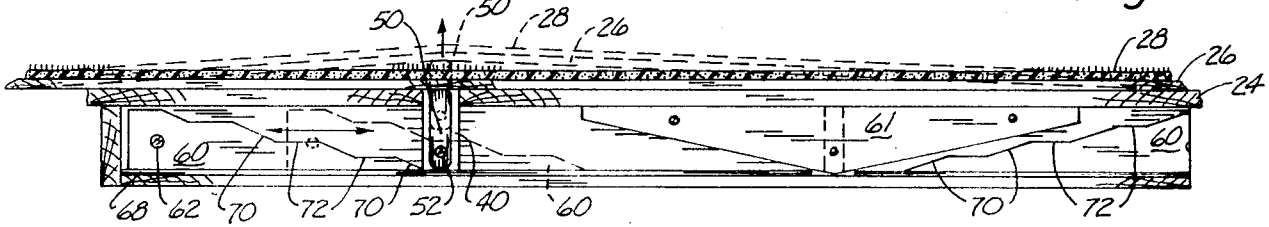
FIG. 11 is a sectional view taken along line 11—11 of FIG. 10 with a dashed line showing of the elevation block under the contour bar to raise one end of the contour bar to contour the putting surface.

FIGS. 10 and 11 show the construction of an intermediate module (14) which includes transverse stringers (13) supporting a subbase (24) to form a level surface interrupted by a pair of transverse slots (40). One or more intermediate modules (14) may be pivotally attached to the end modules (12) by hinges (44) as shown in FIG. 6. It is to be understood that the putting green (10) may be formed of two end modules (12) pivotally attached without an intermediate module (14).

Each end module (12) has one transverse slot (40) and each intermediate module (14) has two transverse slots (40). Once the modules (12, 14) are attached, the flexible resilient base (26) and the flexible putting surface (28) are secured such that the top of the putting surface (28) is substantially flush with the end and side rails (16, 18). The flexible resilient subbase (26) may be formed of Masonite, plywood, or plastic and is generally available in 4'×8' sheets. The ends of adjacent sheets may be joined by a connector (46) as shown in FIG. 8. The putting surface (28) may be formed of a continuous length of carpet that is attached to the subbase (24) only adjacent the end rails (16).

Each of the transverse slots (40) in the end modules (12) and the intermediate modules (14) receives a contour bar (50) that extends across the platform between the side rails (18). The upper edge of each contour bar (50) contacts a transverse section of the underside of the flexible base (26). Each end of each contour bar (50) is independently adjustable between a position where its upper edge is flush with the upper surface of the subbase (24) and a raised position.

As best shown in FIGS. 6 and 7, a rod (52) extends through a vertical slot (54) is the side rail (18) and interconnects the end of the contour bar (50) and an indicator knob (56). A movable elevation block (60) is received in a pocket formed interior of and parallel to each side rail (18) adjacent each end of each of the contour bars (50). An operator rod (62) extends through a horizontal slot (64) and interconnects the elevation block (60) and an indicator knob (66).

As most clearly shown in FIGS. 7 and 11, each elevation block slides on a low-friction strip (68) and contacts the lower edge of the corresponding end of a contour bar (50). A stop (61) limits the travel of the block (60) in the pocket. Each elevation block has, in alternating sequence, a number of inclined surfaces (70) and a number of flat support surfaces (72). As the block (60) is advanced toward the contour bar (50), an inclined surface (70) contacts the lower edge of the contour bar (50) and raises it to a flat support surface (72) where it is supported in a stable raised position. Since the upper edge of the contour bar (50) contacts a transverse section of the underside of the flexible resilient base (26), the vertical movement of the contour bar (50) translates to vertical movement of the base (26) and the overlying putting surface (28).

Thus, each elevation block (60) can be selectively positioned to adjust the contour of the putting surface (28) along the length of the platform. Also, the ends of the platform may be selectively raised by operation of the transverse flaps (34). When each of the blocks (60) is placed in its desired position, the indicator knobs (56, 66) reflect that position so that the position may be later duplicated. Alphanumeric indicia may be placed adjacent the indicator knobs (56, 66), if desired, to provide a convenient way to record the position for later reference.

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

I claim:

1. A selectively contourable putting green comprising:

an elongated platform including a pair of end rails interconnected by a pair of opposing side rails;

a subbase rigidly attached to said platform to form a substantially level surface, said level surface being interrupted by a plurality of transverse slots formed in said subbase and extending between said side rails;

a flexible resilient base including an under side disposed to contact said level surface and an upper side disposed to support a flexible putting surface;

a contour bar including an upper edge and lower edge, said contour bar being received in each of said transverse slots and disposed such that the upper edge is in contacting relationship to a transverse section of the under side of the flexible base, each end of said contour bar being independently selectively adjustable between a first position wherein the upper edge is flush with the level surface of the subbase and a second position wherein the upper edge is fully raised above the level surface of the subbase;

a selectively movable elevation block disposed interior of and parallel to each of said side rails in contacting relationship to the lower edge of said contour bar at each end thereof, each elevation block including, in alternating sequence, a number of inclined surfaces and a number of support surfaces, each of said support surfaces being selectively disposed to engage the lower edge of said contour bar at one end thereof and support it at a discrete elevation; and means for selectively moving said elevation block, whereby the position of each elevation block determines the elevation of one end of each contour bar with respect to the level surface of the subbase which in turn determines the elevation of the transverse sections of the base and the overlying putting surface to produce a selected contour of the putting surface.

2. The putting green of claim 1 wherein said means for selectively moving said elevation block includes a horizontal slot opening formed through the side rail adjacent the elevation block, and an operator rod attached to said elevation block and disposed to extend through said horizontal slot opening to a point exterior of the side rail, whereby selective movement of the operator rod along the horizontal slot opening results in movement of the elevation block with respect to one end of the contour bar.

3. The putting green of claim 2 further including an indicator knob attached to the operator rod at a point exterior of the side rail.

4. The putting green of claim 1 further including means for selectively elevating the end rails.

5. The putting green of claim 4 wherein the means for selectively elevating the end rails includes a transverse flap pivotally attached to the lower edge of the end rail, whereby raising the end rail allows the transverse flap to pivot downwardly to support the end rail in an elevation position.

6. The putting green of claim 5 wherein said elongated platform includes a pair of end modules, each of said end modules including one of said end rails and an interior end, said pair of end modules being pivotally connected at their interior ends.

7. The putting green of claim 6 wherein said elongated platform further includes an intermediate module having opposing ends pivotally attached to the interior ends of said end modules.

8. The putting green of claim 7 wherein said elongated platform includes a plurality of intermediate modlues.

9. The putting green of claim 1 further including a movable pad disposed to be positioned adjacent to said elongated platform and having an elevation similar thereto.

10. The putting green of claim 1 wherein said flexible resilient base is attached to the subbase adjacent the end rails.

11. The putting green of claim 1 wherein said flexible putting surface is attached to the subbase adjacent the end rails.

12. A selectively contourable putting green comprising:

an elongated platform including a pair of end rails interconnected by a pair of opposing side rails;

a subbase rigidly attached to said platform to form a substantially level surface, said level surface being interrupted by a plurality of transverse slots formed in said subbase and extending between said side rails;

a flexible resilient base including an under side disposed to contact said level surface and an upper side disposed to support a flexible putting surface;

a contour bar including an upper edge and lower edge, said contour bar being received in each of said transverse slots and disposed such that the upper edge is in contacting relationship to a transverse section of the under side of the flexible base, each end of said contour bar being independently selectively adjustable between a first position wherein the upper edge is flush with the level surface of the subbase and a second position wherein the upper edge is fully raised above the level surface of the subbase; and means for selectively moving each said end of said contour bar between said first and second positions, whereby the contour of the putting surface is selectively varied.

13. The putting green of claim 12 wherein said means for selectively moving each said end includes:

a selectively movable elevation block disposed interior of and parallel to each of said side rails in contacting relationship to the lower edge of said contour bar at each end thereof, each elevation block including, in alternating sequence, a number of inclined surfaces and a number of support surfaces, each of said support surfaces being selectively disposed to engage the lower edge of said contour bar at one end thereof and support it at a discrete elevation; and means for selectively moving said elevation block, whereby the position of each elevation block determines the elevation of one end of each contour bar with respect to the level surface of the subbase which in turn determines the elevation of the transverse sections of the base and the overlying putting surface to produce a selected contour of the putting surface.

14. The putting green of claim 12 further including means for selectively elevating the end rails.

15. The putting green of claim 14 wherein the means for selectively elevating the end rails includes a transverse flap pivotally attached to the lower edge of the end rail, whereby raising the end rail allows the transverse flap to pivot downwardly to support the end rail in an elevation position.

16. The putting green of claim 15 wherein said elongated platform includes a pair of end modules, each of said end modules including one of said rails and an interior end, said pair of end modules being pivotally connected at their interior ends.

17. The putting green of claim 16 wherein said elongated platform further includes an intermediate module having opposing ends pivotally attached to the interior ends of said end modules.

18. The putting green of claim 17 wherein said elongated platform includes a plurality of intermediate modules.

19. The putting green of claim 12 further including a movable pad disposed to be positioned adjacent to said elongated platform and having an elevation similar thereto.

20. The putting green of claim 12 wherein said flexible resilient base is attached to the subbase adjacent the end rails.

21. The putting green of claim 12 wherein said flexible putting surface is attached to the subbase adjacent the end rails.

* * * * *